US008284976B2

(12) United States Patent
Danley

(10) Patent No.: US 8,284,976 B2
(45) Date of Patent: Oct. 9, 2012

(54) SOUND REPRODUCTION WITH IMPROVED PERFORMANCE CHARACTERISTICS

(76) Inventor: Thomas J. Danley, Highland Park, IL (US)

( * ) Notice: Subject to any disclaimer, the term of this patent is extended or adjusted under 35 U.S.C. 154(b) by 1249 days.

(21) Appl. No.: 11/921,615

(22) PCT Filed: Jun. 6, 2006

(86) PCT No.: PCT/US2006/022032

§ 371 (c)(1),
(2), (4) Date: Dec. 5, 2007

(87) PCT Pub. No.: WO2006/133245

PCT Pub. Date: Dec. 14, 2006

(65) Prior Publication Data

US 2009/0136072 A1 May 28, 2009

(51) Int. Cl.
*H04R 1/20* (2006.01)
*H04R 25/00* (2006.01)

(52) U.S. Cl. ..... 381/342; 381/182; 381/337; 381/338; 381/339; 381/340

(58) Field of Classification Search ..... 381/182, 381/337–340, 342
See application file for complete search history.

(56) References Cited

U.S. PATENT DOCUMENTS

| | | | | |
|---|---|---|---|---|
| 2,900,040 | A * | 8/1959 | Novak | 181/152 |
| 4,071,112 | A * | 1/1978 | Keele, Jr. | 181/187 |
| 7,275,621 | B1 * | 10/2007 | Delgado, Jr. | 181/192 |
| 2002/0106097 | A1 * | 8/2002 | Danley et al. | 381/345 |

* cited by examiner

*Primary Examiner* — Mohamad Musleh
*Assistant Examiner* — Tsz Chan
(74) *Attorney, Agent, or Firm* — Olson & Cepuritis, Ltd.

(57) ABSTRACT

A sound reproduction system is disclosed in which a sound barrier defines a horn passageway having a first end and a second open end. A high frequency range driver is provided at the first end, and is mutually coupled with a lower driver to the horn passageway. The lower driver has an upper frequency end lower than a frequency of a first cancellation notch for the drivers. The lower driver is located at a position along the horn passageway at which the passageway has a preselected cross-sectional area which is no greater than an area of a round cross section having a circumference equal to one wavelength at the upper frequency end.

6 Claims, 8 Drawing Sheets

SOUND REPRODUCTION WITH IMPROVED PERFORMANCE CHARACTERISTICS

FIELD OF THE INVENTION

The present invention relates to sound reproduction systems having multiple drivers, mutually coupled to a sound barrier to simulate a single acoustic source in time with a single source radiation pattern.

DESCRIPTION OF THE RELATED ART

Originally, the art of horn loading of drivers was done to increase the electroacoustic efficiency of the drivers. Various techniques were employed early on to make the most of limited amplifier power and relatively low power handling capabilities of available drivers. Early efforts were centered around obtaining the greatest sound level possible. Horn loaded speakers, sometimes referred to simply as "horns" or "warning systems" of this early era were generally designed to have a specific expansion rate throughout, and typically were made to have a defined shape such as that of a simple cone as well as curved wall flares having shapes corresponding to exponential or hyperbolic curves. Typically, these designs were aimed at giving the best low-frequency performance.

Complementary horn/driver systems were developed for different frequency ranges. The design of relatively low frequency horns encountered challenging problems because of the mass and acoustic size required. Once the desired frequency range is made high enough, it becomes easier to make a horn for a particular range which is large enough to meet design criteria. However, difficulties arose in attempts to make a horn driver having a relatively flat acoustic power response above 2 or 3 kHz. It was possible to design drivers early on to have a reasonably flat response "on-axis" to several octaves above a low range, largely because these horns typically have a "curved wall" construction which exhibited a directivity which narrows with increasing frequency. Many popular early designs had favorable response characteristics because the narrowing "focus" of the horn pattern closely compensated for the falling acoustic power of the horn drivers, with increasing frequency. However, situations arose in where listeners could not be positioned "on axis". Most notably, severe high frequency roll off was experienced as a listener moved away from the central axis of the sound reproduction system.

Constant directivity horns were developed in an effort to provide a consistent sound quality to larger audiences, so as to overcome the focusing effect of curved wall horns. Unfortunately, practical constant directivity horns produced considerably less low-frequency loading on the drivers than the popular exponential-shape curved wall horns for which improvements were sought. Fortunately, power amplifiers having greater output were made available and horn drivers were being produced with greater power capability.

The inventor of the present invention, while investigating the poor loading on constant directivity horns, gave attention to "pyramid" shaped horns. These types of horns were found to have an effective expansion rate which changes greatly according to the distance from the apex, while having a very rapid expansion rate at the apex. The expansion rate becomes considerably slower as the mouth of the horn is approached. While the compression drivers at the apex did not couple low-frequencies as effectively, lower frequency ranges could be injected forward of the apex, where the expansion rate was slower and more suited to lower frequency loading. Further details can be found in U.S. Pat. No. 6,411,718 B1 which issued Jun. 25, 2002 to Thomas J. Danley, inventor of the present invention, and Bradford J. Skuran.

While a simple conical horn can have nearly constant directivity over a defined frequency range, a paradox was found when trying to cover a relatively wide frequency range. Practical systems are limited in frequency range since only systems developed for relatively narrow frequency ranges could achieve greater output and efficiency in real-world designs. A combination of both high output and wide frequency ranges require the overall frequency span to be divided into smaller sub ranges or segments. This conventionally requires each frequency range and drivers to be associated with an appropriate horn developed for the desired range. When combining horns of multiple sub ranges, even with horns placed edge to edge, objectionable interference is observed where the ranges overlap, resulting in dispersion patterns with lobes or beans of energy emanating in undesirable directions. Attempts have been made to overcome this problem by placing the high-frequency horn in the mouth of the lower frequency horn, although fairly sophisticated signal processing is required to compensate for the differing time origins of the two sources. Even when the achievement of design goals was possible, such compensations could be developed only for a single point in the listening area, and if one were to move about the listening area, advantage of the compensation would be lost.

Accordingly, sound reproduction systems which truly appear to be that of a single driver in time and in angular dispersion properties is still being sought. Further, reductions in total phase shift of multisegment horn/driver sound reproduction systems are also being sought.

SUMMARY OF THE INVENTION

The present invention provides a novel and improved sound reproduction system in which a sound barrier defines a horn passageway having a first end and a second open end. At least one high frequency range driver is provided at the first end, and at least one lower driver operating in a frequency range lower than the high frequency range driver are also provided. The high frequency driver and the lower driver are mutually coupled to the horn passageway.

In a first example of a sound reproduction system according to principles of the present invention, the lower driver has an upper frequency end lower than a frequency of a first cancellation notch for the lower driver.

In a second example of a sound reproduction system according to principles of the present invention, the lower driver has an upper frequency end and is located at a preselected position along the horn passageway at which the passageway has a preselected cross-sectional area which is no greater than an area of a round cross section having a circumference equal to one wavelength of the upper frequency end.

In a third example of a sound reproduction system according to principles of the present invention, the lower driver has a lower frequency end and is located at a point along the horn passageway having a preselected expansion rate which is slower or equal to the low cut off or expansion rate governed by the high pass frequency for the horn.

DESCRIPTION OF THE PREFERRED EMBODIMENTS

Figure 2:
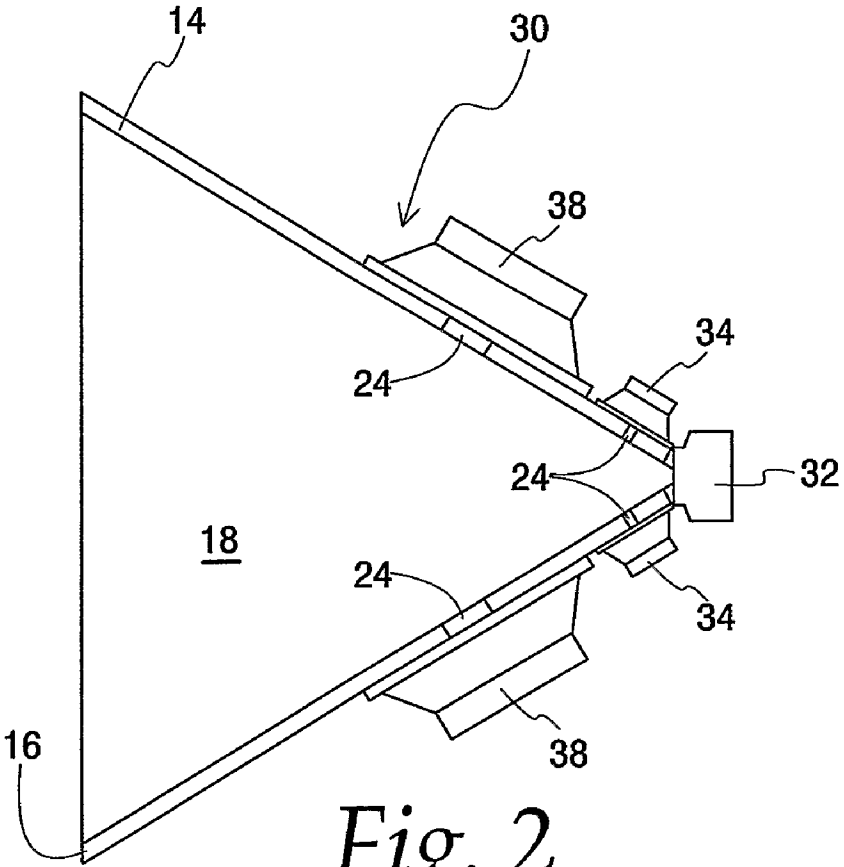
FIG. 2 is a schematic cross-sectional view of a second embodiment of a sound reproduction system illustrating certain aspects of the present invention.

The invention disclosed herein is, of course, susceptible of embodiment in many different forms. Shown in the drawings and described herein below in detail are the preferred embodiments of the invention. It is to be understood, however, that the present disclosure is an exemplification of the principles of the invention and does not limit the invention to the illustrated embodiments.

For ease of description, sound reproduction systems embodying the present invention are described herein below in their usual assembled position as shown in the accompanying drawings and terms such as front, rear, upper, lower, horizontal, longitudinal, etc., may be used herein with reference to this usual position. However, the sound reproduction systems may be manufactured, transported, sold, or used in orientations other than that described and shown herein.

At the outset it is noted that, while many different types of sound reproduction systems can receive substantial benefit from the present invention, the present invention has found immediate acceptance in the field of horn/driver sound reproduction systems. Accordingly, discussion of the present invention will begin with several examples of sound reproduction systems having one or more drivers mutually coupled to a horn constructed according to virtually any of a number of known designs.

Figure 1:
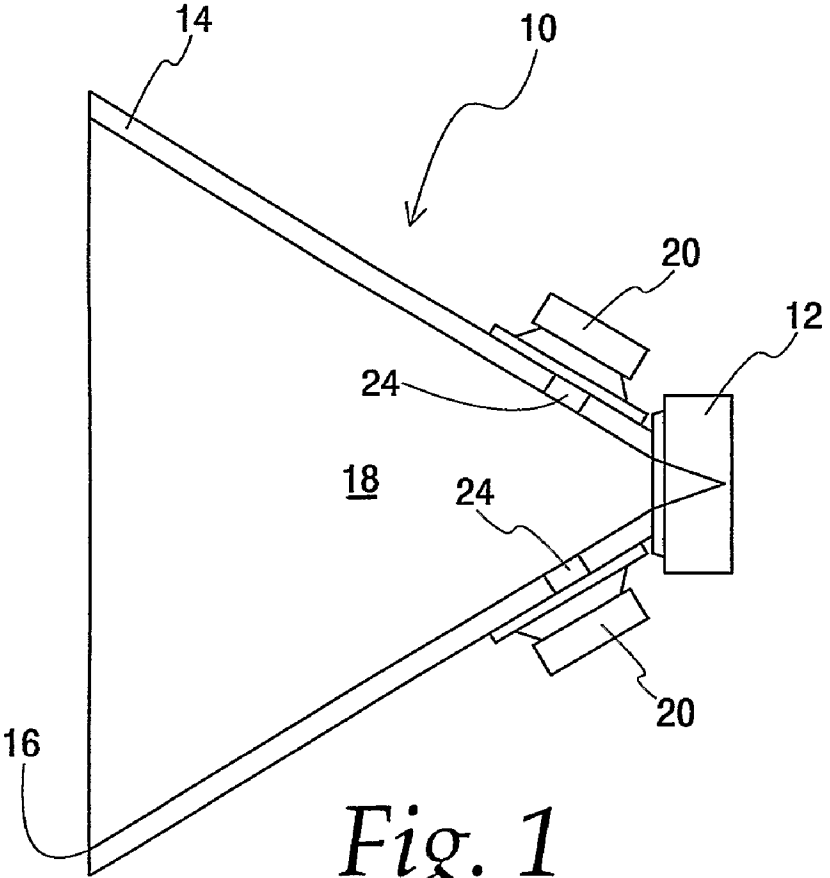
FIG. 1 is a schematic cross-sectional view of a first embodiment of a sound reproduction system illustrating certain aspects of the present invention.

Referring now to FIG. 1, a sound reproduction system embodying certain aspects of the present invention is generally indicated at 10. A high frequency driver 12 is mounted at one end of an acoustic boundary or sound barrier 14 to effectively close that end, acoustically. The sound barrier 14 has an opposed open end or mouth 16. A pair of lower frequency, or "lower" drivers 20 are mounted to the sound barrier adjacent the closed end. As can be seen, drivers 20 are mounted on the outside of the sound barrier, away from the acoustic passageway 18 defined by the sound barrier 14, Acoustic output from drivers 20 is introduced into the acoustic passageway by ducts or acoustic output ports such as cylindrical ports 24 formed in the sound barrier 14. The length of the ports 24 accordingly corresponds to the local thickness of the sound barrier 14.

Figure 9:
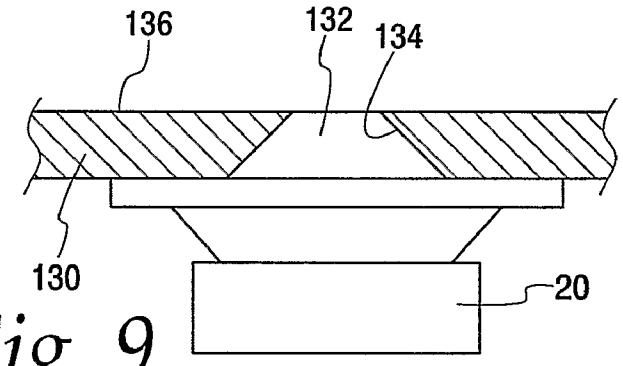
FIG. 9 is a schematic cross-sectional view of another embodiment of a sound reproduction system according to aspects of the present invention.
Figure 10:
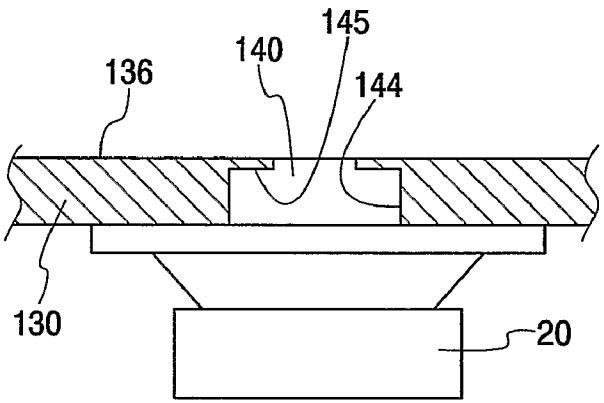
FIG. 10 is a schematic cross-sectional view of a further embodiment of a sound reproduction system according to aspects of the present invention.

Referring now to FIGS. 9 and 10, the port length, or acoustic length can be minimized significantly for horn walls that are relatively thick. Referring to FIG. 9, a lower frequency driver 20 is shown mounted to horn wall 130. A tapered port 132 is formed in horn wall 130. The tapered port 132 is preferably defined by frustoconical wall 134 having a large end adjacent driver 20 and a smaller end adjacent the outer surface 136 of the horn wall. Referring now to FIG. 10, a stepped port 140 is formed in horn wall 130, and is defined by stepped wall 144. The port defined by the stepped wall has a larger diameter adjacent driver 20 and a smaller diameter adjacent the outer surface 136 of the horn wall. As shown in FIG. 10 it is generally preferred that the step or transition 145 in wall 144 is located relatively close to the outer surface 136. With either port treatment shown in FIG. 9 or FIG. 10, the overall opening in horn wall 130 can be made substantially smaller than if a "straight" or cylindrical hole were employed.

The present invention, in one example, has found immediate application with horn-loaded loudspeaker systems. As contemplated herein, a "horn" is an air passageway defined by one or more walls that are acoustically solid, presenting an acoustic boundary which contains the sound pressure until the sound signals reach the horn mouth 16. Accordingly, in an effort to reduce discontinuities in the acoustic boundaries of the horn, and to avoid adding "soft" surfaces within the acoustically solid horn wall, drivers are located outside of the horn, with their sound output introduced into the horn interior passage via ducts or ports.

It is desirable to keep the acoustic output ports such as ports 24, 132 and 140 relatively small (in cross-sectional area) to avoid acoustic discontinuities. It is been found that, with a minimum port length, the cross-sectional area or size of the port opening can be reduced significantly. In one example, ports in a prior art midrange section have a length of three quarters of an inch. By reducing the port lengths to 1/16 of an inch, the ports could be reduced in number from 8 to 4 and in size from ¾ of an inch to ⅝ of an inch.

The sound barrier or horn 14 can take any of the number of desirable shapes and forms as may be needed for a particular application. The present invention, as will be seen herein, can be readily adapted to horns of virtually any shape, and is not limited to the "straight conical" shape shown in FIG. 1. Further, while two low drivers 20 are illustrated in FIG. 1, there can be any number of low-drivers as may be required. For example, for square, rectangular or pyramidal shaped horns, a driver may be provided on each flat portion of the horn. Also, while only a single high frequency driver 12 is shown in FIG. 1, system 10 can employ two or more high frequency drivers, as may be desired. Further, as will be seen with reference to FIG. 2, the overall frequency spectrum of the original or source signal can be divided into three or more segments, with sound reproduction systems having drivers/crossover subsystems for each segments, all mutually coupled to the same horn.

The example illustrated in FIG. 1 is sometimes described as a "two-way" system, indicating that the overall or source acoustic signal to be reproduced is divided into two operational segments. The source acoustic signal can be divided in a number of different ways, but typically is divided in multiple segments according to frequency ranges. In one example, the source acoustic signal is divided electrically, with different frequency segments being routed to the high frequency driver 12 and the lower drivers 20. As mentioned above, the output from the high frequency driver 12 and lower drivers 20 is mutually coupled to the acoustic passageway 18, with the combined result emanating from mouth 16.

Referring now to FIG. 2, a second embodiment of a sound reproduction system according to principles of the present invention is generally indicated at 30. Included in the system are three segments of audio reproduction devices or "drivers", each assigned to a generally different frequency range. In system 30, the overall frequency range of the source acoustic signal is divided into three segments by electronic circuitry (usually referred to collectively as a "crossover"), not shown. Accordingly, system 30 is referred to as a "3-way" system. A high frequency driver 32 is placed at the narrow end of horn passageway 18, and effectively closes that end of the sound barrier or horn 14. So-called "mid-range" or "mid" drivers 34 are mounted to the outside of horn 14, adjacent the high frequency driver 32. The mid-range drivers 34 are located between high-frequency driver 32 and a pair of so-called "bass" drivers 38.

The term "lower drivers" is used herein to refer to drivers which handle frequency ranges lower than that of the high-frequency driver. Thus, in the three-way illustrated in FIG. 2, there are two pairs of so-called "lower" drivers, namely the pair of drivers 34 and the pair of drivers 38. The two-way system illustrated in FIG. 1 has a single pair of "lower drivers", namely the pair of drivers 20. The present invention contemplates acoustic systems divided into more than three segments, and thus having lower drivers accommodating more than two frequency ranges lower than the high frequency range.

Acoustic output from the drivers 34 and 38 is directed to horn passageway 18 through respective passageways 24 extending through the sound barrier or horn 14, in the manner described above with reference to FIG. 1. As used herein, the terms "mid" or "bass" are relative, and bear reference to the subsystem with which they are associated. Thus, the mid drivers produce acoustic output in response to electrical signals having a frequency range lying between the frequency range of the high-frequency driver 32 and the bass drivers 38. It is not surprising to find that the acoustic output from the respective drivers 32, 34 and 38 have different wavelength ranges and, of necessity, are located at different distances from the mouth of the horn. While only a single high frequency driver is shown in FIG. 2, two or more high frequency drivers could be employed, as desired. As mentioned, system 30 is commonly referred to as a "three-way" system with the overall frequency range of the originating signal being divided into three sub ranges, each having their own respective frequency range. When sound reproduction systems are constructed according to principles of the present invention, the output of the three component sub-ranges are mutually coupled into a common horn passageway so as to emerge with the appearance of a single acoustic source in time with a single source radiation pattern. If desired, the originating acoustic signal can be divided into four or more sub ranges as may be desired, with one or more acoustic drivers usually associated with each sub range. Regardless of the number of ranges, it is generally preferred that rear radiation from each frequency range is kept separate by the use of a sealed enclosure constructed according to known principles such as those specified in the paper "On The Specification Of Moving Coil Drivers For Low-Frequency Horn-Loaded Loudspeakers" by Marshal Leach, Audio Engineering Society Loudspeaker Anthology, Volume 2.

As is known in the art, the design of sound reproduction systems often involves a balancing of different design principles, directed to optimizing different aspects of system performance. The present invention can be combined with a wide variety of techniques known in the art, to aid in obtaining sound reproduction systems which simulate a single acoustic source in time with a single source radiation pattern, and with a heretofore unattainable minimum phase shift and total group delay. While known techniques have enjoyed some measure of success, substantially greater performance is made possible only with the present invention, as can be seen for example, by comparing the responses shown in FIGS. 4 and 5, described below. It has been discovered that certain aspects of the horn design must be satisfied if a substantial reduction in total phase shift is to be achieved in a system which more closely simulates a single acoustic source in time with a single source radiation pattern.

Figure 3:
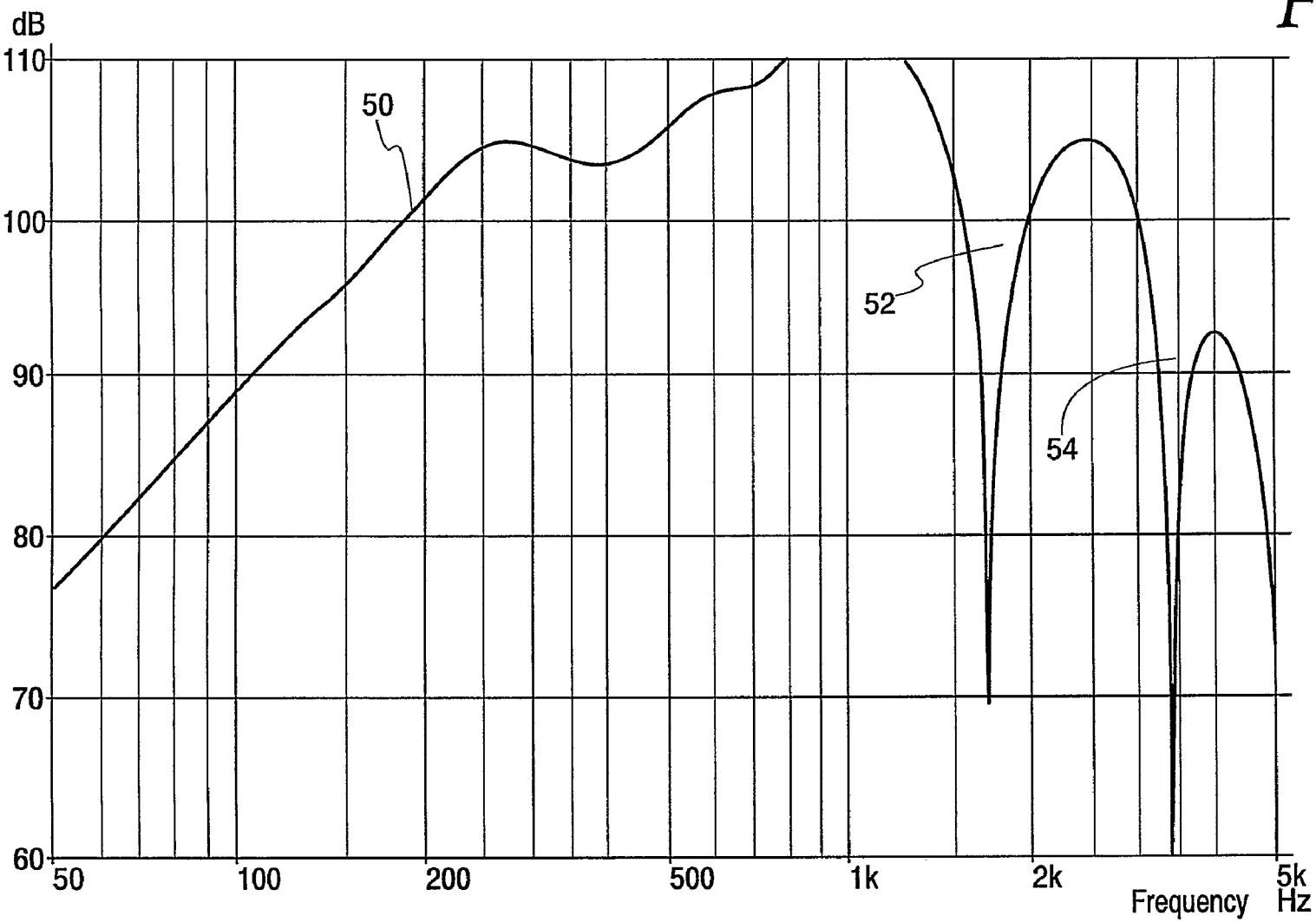
FIG. 3 is a graphical representation showing notch cancellations for a lower driver mounted to a horn passageway.

Referring to a first aspect of horn design according to principles of the present invention, attention is directed to the upper end of the frequency range of operation of the lower drivers. At the upper frequency end of the range of each lower driver, each lower driver must be limited to operation below the frequency point where the first cancellation notch occurs. Cancellation notches appear when the frequency is increased sufficiently so that sound from the driver, which travels to the closed end of the horn, is reflected back so as to arrive with 180° of phase shift to cancel that portion of the source information, thereby causing the cancellation notch. Accordingly, a low pass filter or other arrangement is provided for each of the lower drivers, to provide high-frequency cut off starting below that point where the first cancellation notch occurs for the respective lower drivers. It is important to note that this determination related to the first cancellation notch of each respective lower drivers is not a physical distance but rather is an acoustic dimension governed by the shape and size of the horn passage. Referring now to FIG. 3, a response curve for an exemplar lower driver is shown at 50. First and second cancellation notches 52, 54, are clearly visible.

Referring to a second aspect of horn design according to principles of the present invention, attention is directed to the local cross-sectional area of the horn where a lower driver is located. At the upper frequency end of each of the lower drivers, the cross-sectional area of the horn, where the driver's output enters the horn, must be no greater than the area approximated by a round cross section that is one wavelength in circumference at that upper frequency end.

Referring to a third aspect of horn design according to principles of the present invention, attention is directed to the local expansion rate of the cross-sectional area of the lower drivers. As used herein, the term "local expansion rate" refers to the distance it takes for a small but readily measurable increase in area of the acoustic passageway (e.g. doubling of the acoustic passageway cross-sectional area), starting at a point where the driver is tapped into the horn. Thus, the term "local expansion" bears reference to a small portion of the acoustic passageway as opposed to a reference to the expansion throughout the overall length of the horn. A useful formula for calculating the horn cross-sectional area at a distance X from the horn throat is given as:

$$Ax=At(\cosh(X/Xo)+T*\sinh(X/Xo))^2,$$

where Ax is the area at a given point, At is the initial or throat area, X is the distance from the throat, Xo is the low cut off or expansion rate governed by the "high pass" frequency for the horn, and T is the expansion type (e.g. 1 for an exponential horn, <1 for a hyperbolic horn, and infinity for a conical horn). This formula immediately above is given in a paper entitled "Design Factors In Horn-Type Loudspeakers" by Daniel Plach, Jensen Manufacturing Co., Audio Engineering Society Loudspeaker Anthology, Volume 1. In one example, this formula is used to calculate the value of frequency Xo for the horn being studied, to determine if the calculated value of Xo (which applies to the rest of the horn going forward from the calculation point, i.e. the point where the driver is tapped into the horn) is no greater than that for the lowest frequency in the frequency range of driver operation. At the lower end of each driver's range, the local expansion rate of the cross-sectional area (taken at that point along the horn where the lower driver's output enters the horn) must be no faster than that specified for that lower frequency end by the equation given immediately, above. As is known, the expansion rate governs the frequency-dependent loading behavior of the horn as a signal passing through the horn approaches its low cut off frequency.

The present invention can be employed with virtually any type of horn design, such as straight conical horns and curved wall horns, as well as more complex horn shapes such as those associated with constant directivity designs, of the type directed to overcoming particular problems such as pattern flip usually associated with straight conical horns. The downstream portion of the horn can be designed according to any of a number of known principles. For example, the expansion rate is considered as having an effect of a "high pass" filter, in that the rate of expansion is an important factor governing how low the horn will provide a loading advantage, with attendant increase in efficiency, over a direct radiator version for the same driver. For example, a 30 hertz exponential expansion of a horn doubles the cross-sectional area of the horn passageway for every 24 inches of passageway length, while a 120 hertz expansion doubles the area every 6 inches. This advantage of horn loading results from the ability of a horn to present the acoustic load of a radiator of a much larger area, while avoiding issues of increased mass and breakup of acoustic signals that a physically larger radiator would impose. Thus, the efficiency of the system is increased due to the greater acoustic load, as compared to the driver's losses. The basic design of a system having a horn and one or more drivers involves a consideration of the best impedance match between the horn and the drivers coupled to the horn. In practical systems, a 10 to 30 fold improvement in electroacoustic efficiency over that of a direct radiator is commonly achieved, resulting in an electroacoustical efficiency ranging between 30 and 50%.

It is generally preferred that a horn is employed in a region of operation where it provides a substantially constant acoustic load on the drivers. Accordingly, it is assumed that the mouth size of the horn is made large enough to provide the required impedance transformation down to the low cut off of the drivers. When considering a calculation of the acoustic radiation resistance with respect to radiator acoustic size relative to the wavelength considered, it is observed that, when the radiator is greater than a specific acoustic size, its radiation resistance is substantially constant with regard to frequency of operation. Conversely, if the radiator size is substantially below the acoustic size, the radiation resistance changes along a sloped curve of size versus frequency. In one example, a minimum mouth size of a horn is preferred to be equivalent to a diameter which gives a circumference of approximately one wavelength at the low cut off frequency of the drivers being studied. Some advantage in size reduction of the horn mouth can be obtained when fractions of a wavelength in circumference are considered. However, the advantages in a practical system are not expected to be substantial, compared to a circumference having a length of one wavelength.

At the low-frequency cut off, the horn path length emerges as a factor which must be considered. In general, the horn path length must be about one quarter wavelength or longer at the low cut off frequency, although substantial efficiency begins in a design region where the horn path length is at least one half wavelength. For practical designs of low-frequency horns, the physical dimensions needed to achieve a substantially constant acoustic load becomes prohibitive. On the other hand, when horn designs are considered in frequency ranges which are an octave or two above a subwoofer range, the physical size is physically smaller and acoustically large enough to give desired performance.

When considering the interaction between low cut off and the mouth size of practical horns, attention is given to the fact that, as the frequency is increased above the low cut off, the horn becomes larger than necessary to load this frequency. For example, a size of about one wavelength in circumference needed to reach a constant acoustic load at a particular frequency is roughly half the circumference when the frequency under consideration is increased by an octave. Thus, the design point needed to achieve optimal acoustic loading moves up the horn, toward the throat (or closed end) of the horn, with attendant narrowing directivity as the frequency under consideration increases. The part of the horn past the point of acoustic loading is important since it governs the radiation pattern of the sound reproduction system.

Figure 4:
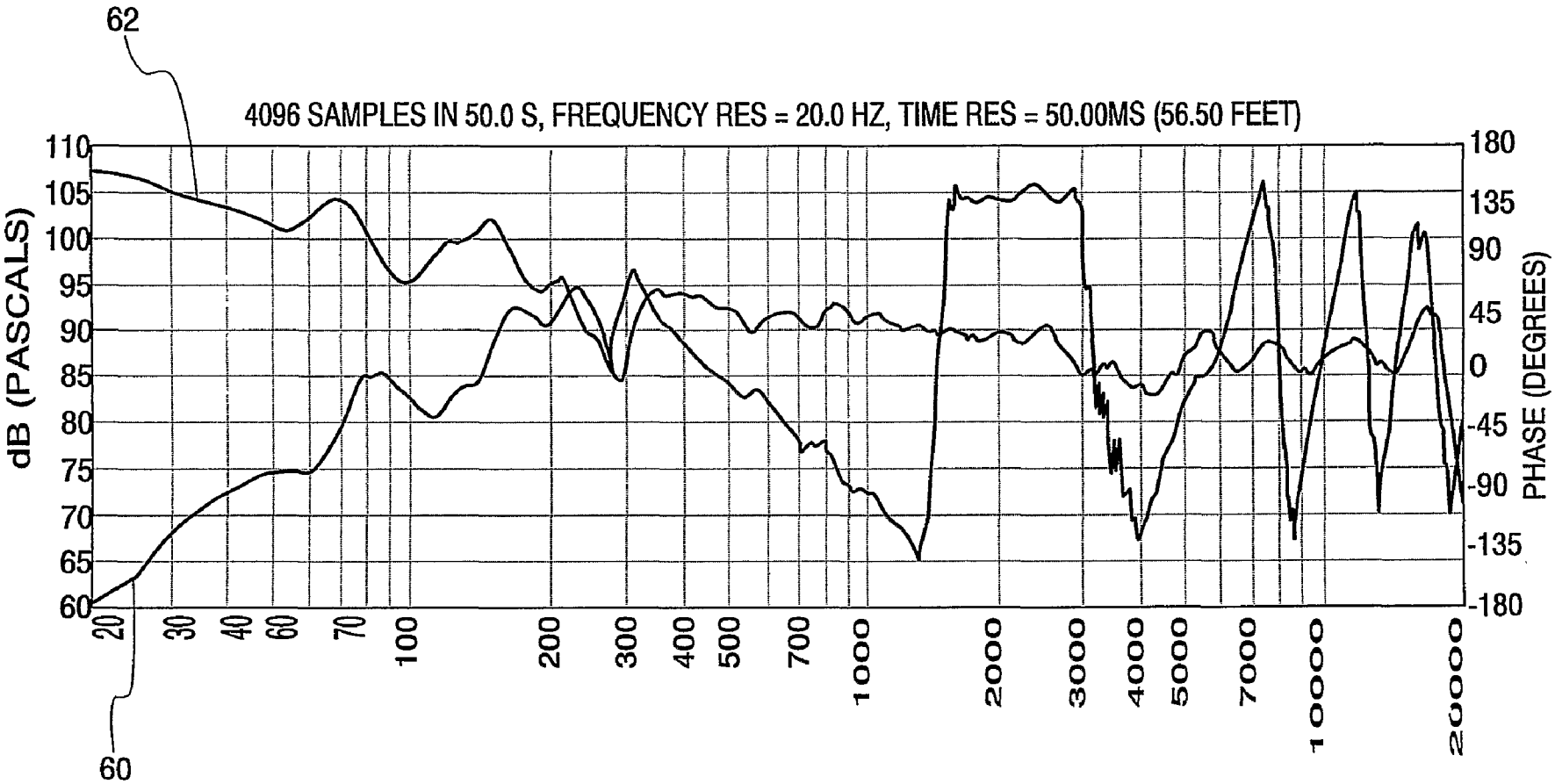
FIG. 4 is a graphical representation of the performance of a prior art sound reproduction system.
Figure 5:
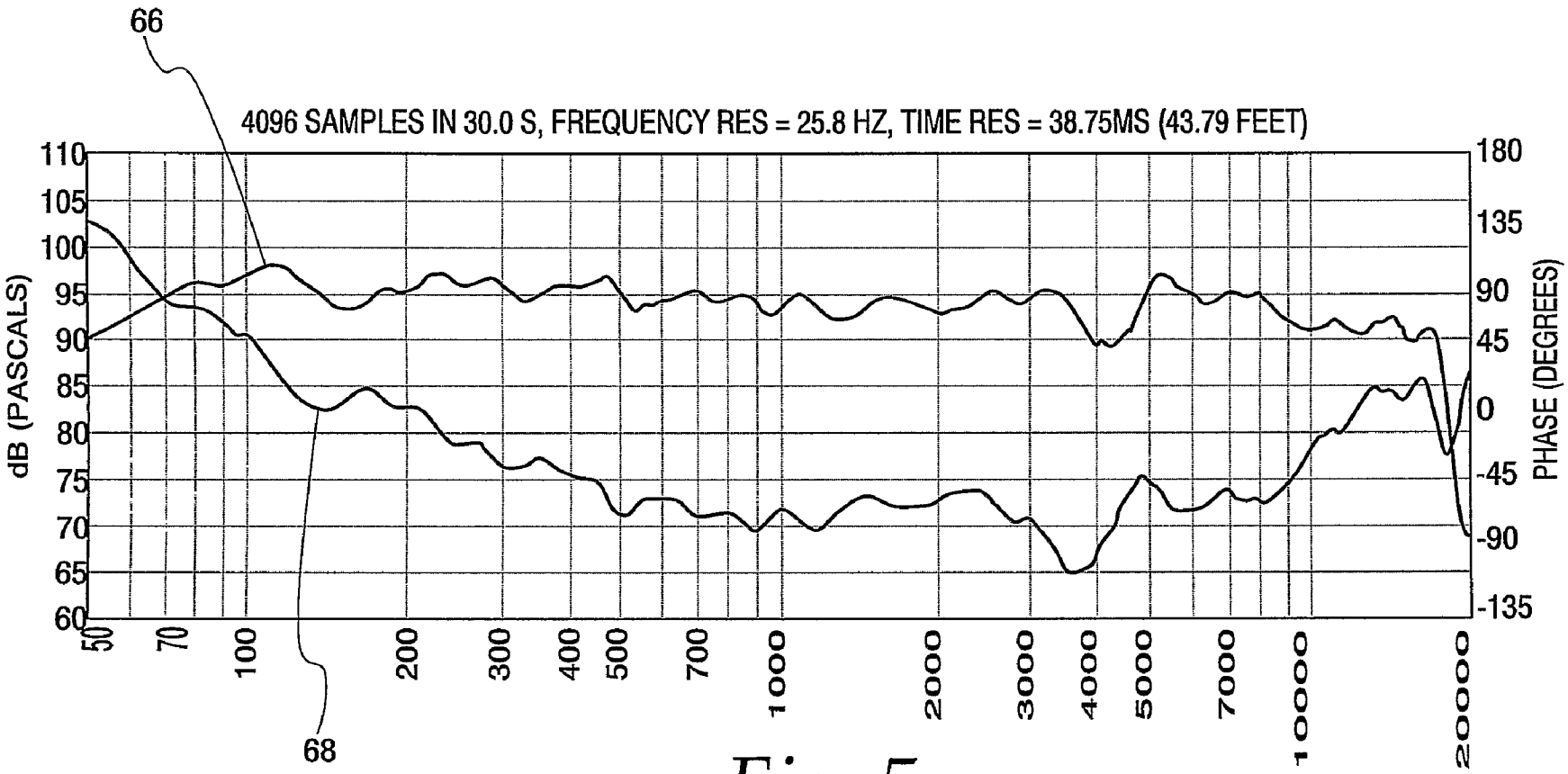
FIG. 5 is a graphical representation of the performance of the sound reproduction system of FIG. 4 which has been improved according to aspects of the present invention.

For comparison purposes, and to illustrate advantages attainable with the present invention, a prior art horn/driver sound reproduction system was modified according to aspects of the present invention. A three-way sound reproduction system, Model Number td-1, commercially available from Sound Physics Labs, Inc. of Glenview Ill., was tested for both frequency and phase response characteristics. The system employs a straight conical horn having a pyramidal shape. Referring now to FIG. 4, the frequency response curve 60 and phase response curve 62 are shown for the unmodified system. The system was then modified to relocate the drivers with respect to the horn and to replace the crossover with new electronics, in accordance with principles of the present invention and was tested under circumstances similar to the test shown in FIG. 4, with the result illustrated in FIG. 5. The frequency response curve 66 and the phase response curve 68 of FIG. 5 shows substantial improvement over the performance of the unmodified system indicated in FIG. 4. With the sound reproduction system according to principles of the present invention the phase shift indicated by curve 66 is much closer to 0 degrees. Also, in addition to the reduction in phase shift throughout the pass band, the amplitude curve 66 is smoother than the corresponding amplitude curve 60 for the unmodified system response indicated in FIG. 4. Thus, the modified according to principles of the present invention has much less group delay than the original, unmodified system, even though the same drivers and the same physical shell were used in both systems.

Figure 11:
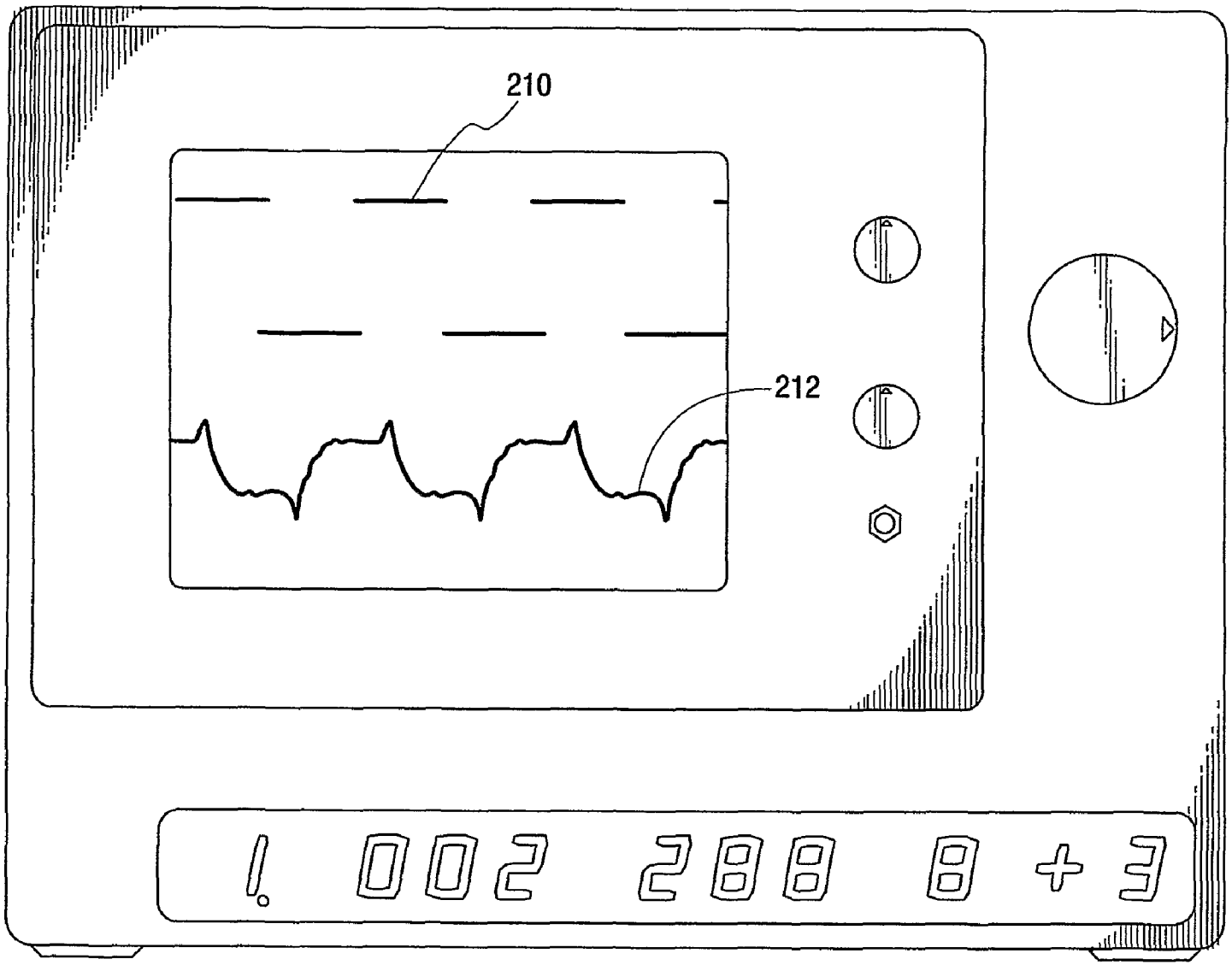
FIG. 11 is a schematic representation of an instrument taking a first performance reading of a sound reproduction system according to aspects of the present invention.
Figure 12:
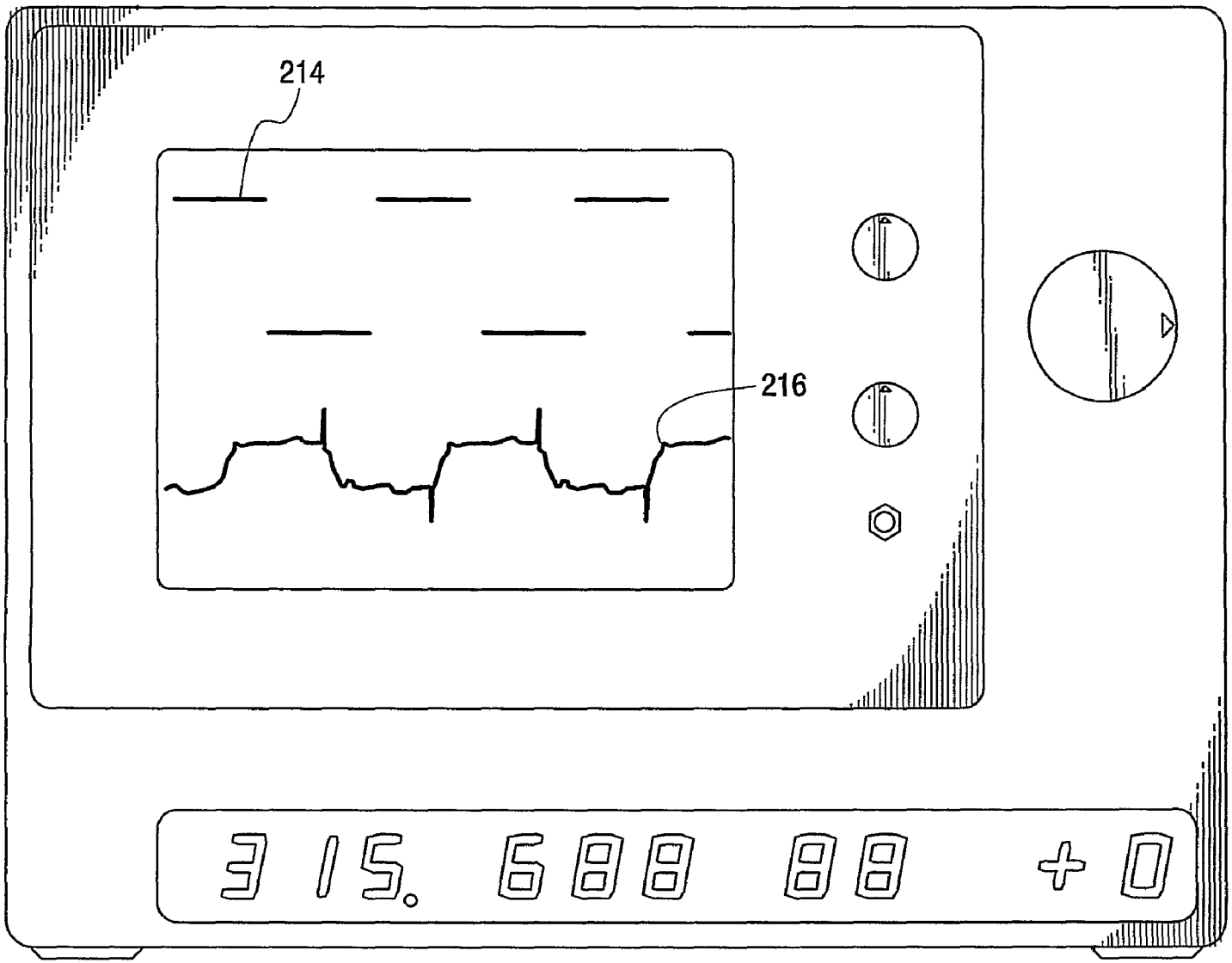
FIG. 12 is a schematic representation of an instrument taking a further reading of a sound reproduction system according to aspects of the present invention.

Turning now to FIGS. 11 and 12, the modified system was tested for a square wave response. In FIG. 11, the sound reproduction system was tested with a square wave input signal 210 operating at a frequency of approximately 1.002 kHz, at or very close to the upper crossover frequency for the sound reproduction system. The output trace 212 shows a very good conformance to the square wave shape with only a small rise at the trailing end of each pulse in the wavetrain. FIG. 12 shows a square wave test at the lower crossover frequency of approximately 315 Hz. The input square wave 214 is closely followed by the output trace 216, again showing only a slight rise at the trailing end of each pulse of the wavetrain.

In addition to the testing discussed above, sound reproduction systems similar to those considered herein were tested for a number of other factors such as sensitivity, radiation pattern and the ability of multiple systems to be arrayed together to cover a large listening field such as a wide, large auditorium. The average sensitivity measured was quite high, 99 dB re. 20 μPa with 2.83 Vrms applied across the load speaker terminals. While the sound reproduction systems exhibited a large high frequency radiating area, a tight radiation pattern in the multiple transducer system contributed to the high sensitivity. In addition, the sound reproduction systems exhibited relatively tight pattern control over a wide frequency range, allowing multiple systems to be placed side-by-side to transmit clean sound to a wide field. In short, the radiation pattern was found to be quite good, performing better than even contemporary examples of prior art systems.

Figure 6:
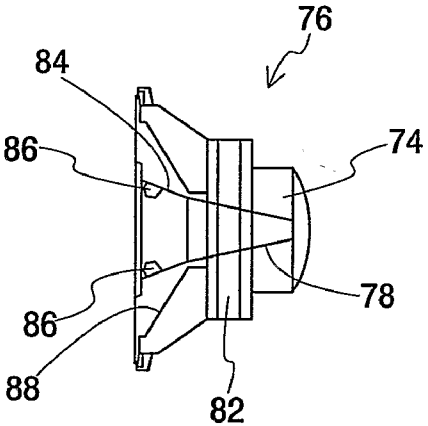
FIG. 6 is a schematic cross-sectional view of a coaxial driver according to aspects of the present invention.
Figure 7:
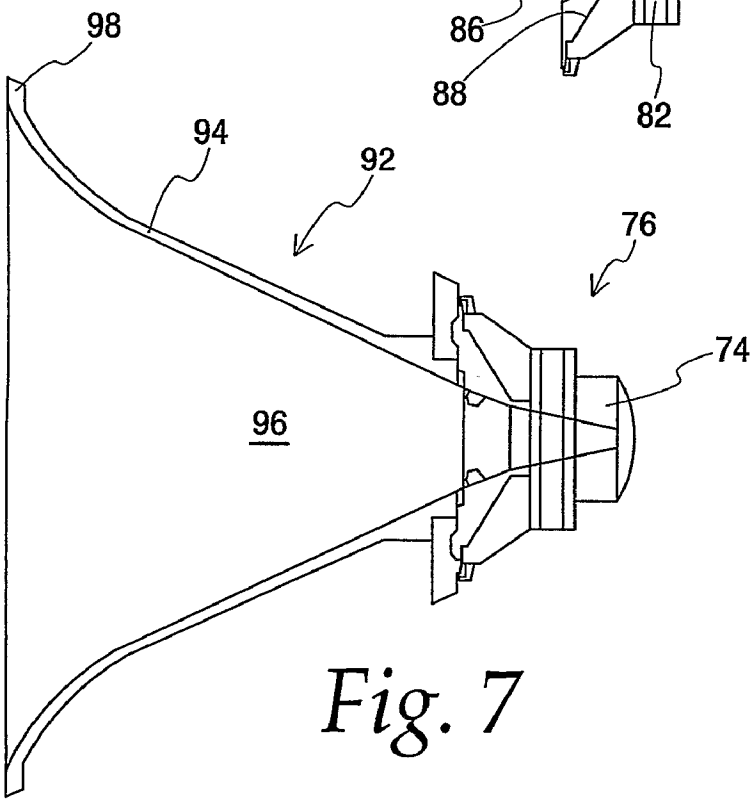
FIG. 7 is a schematic cross-sectional view of the coaxial driver of FIG. 6 connected to an exemplar horn passageway.

Turning now to FIGS. 6 and 7, attention is given to the directivity of a sound reproduction system. It has been found that the shape and size of the horn governs directivity over a span of frequencies for horn/driver acoustic reproduction systems. When carefully considering the design of a particular horn system, it is important to note that the horn effectively begins at a point within the high frequency driver, such as the high frequency driver 74 of the coaxial driver assembly generally indicated at 76 in FIG. 6. Construction lines 78 are shown to illustrate this point. This beginning point for the horn, that is, the smallest point in the horn path way, is related to the internal geometry of the horn which is set at manufacture. Thus, a designer faces some initial constraints when the high frequency driver element is selected.

The coaxial driver 76 includes a lower frequency driver element 82, as shown in FIG. 6. Assembly 76 further includes a horn section 84 having a plurality of holes 86, of sufficiently large diameter to communicate sound pressure from the cone driver 88 of the lower frequency element 82 to the interior of cone 84. In the illustrated embodiment, four equally-spaced holes are employed. The horn section 84 is preferably made of relatively thin gauge material, so that the holes 86 form ports of relatively small path length. As can be seen in FIG. 6, the angle of cone 84 is made to coincide with the internal angle within high frequency driver 74.

Referring to FIG. 7, a sound reproduction system 92 includes the coaxial driver assembly 76 mounted to a sound barrier or horn 94 having a horn passageway 96 extending to a mouth 98. Again, the upstream or initial end of horn 94 (located adjacent coaxial driver assembly 76) has an angle consistent with that of horn section 84 and the internal geometry of high frequency driver 74 as indicated by construction lines 78 (see FIG. 6). The continuity of angular values between the internal geometry of the high frequency driver, the horn section 84 and the horn 94 is preferred when the inner horn has directivity in its operating range. Further, when the horn section 84 has directivity, it is generally desirable that the smaller end of horn 94 has a similar wall angle to avoid reflections. That portion of horn 94 located downstream, i.e. adjacent mouth 98 has a curvature governed by its intended application and low-frequency cut off.

According to one example of carrying out the present invention, the approximate frequency at which a horn has directivity in its operating range is calculated according to the following formula:

$$F1=K/Ha*Xm,$$

where F1 is the frequency above which the directivity of the horn is set by the horn wall angle, Xm is the horn width at a particular point (in inches), Ha is the horn wall angle (i.e. measured wall-to-wall for the cross-section at the point of the horn being studied), and K is a constant equal to 10^6. This formula is obtained from a paper by Don Keeles, presented at the 58th convention of the Audio Engineering Society, and is in reference to the mouth dimension governing a horn's radiation pattern. However, the mathematical principles of the formula, according to one principle of the present invention, is applied to a point removed from the horn mouth, along the acoustic passageway where one portion of a horn section joins another. As the frequency increases, that portion of the horn that sets the radiation angle at that frequency and at the point of interest along the horn passageway grows increasingly closer to the horn throat. Accordingly, the goal to obtain constant directivity, or a minimum of internal acoustic reflections, is achieved by making approximately equal the horn wall angles were one horn section joins another, down to a dimension where the F1 frequency is equal to or higher than the highest frequency in the operating range of interest.

As mentioned above, the sound reproduction system improved by application of principles of the present invention produces a smoother amplitude response and lower phase shift response, as illustrated in FIG. 5, when taken in comparison with the response of a prior art system illustrated in FIG. 4. Also, with a conventional crossover such as a fourth order Linkwitz high pass/low pass summed filter, the geometry and close coupling between ranges of systems according to principles of the present invention allow the designer to minimize group delay well below that of a conventional crossover. For systems constructed according to principles of the present invention, all of the drivers interact or "feel"each other acoustically, due to their close proximity and their loading into a mutually coupled horn passage. To have the assembly of components of the system act as a single source in time, the crossover employed should be based on each driver's amplitude and phase response over the operating frequency range. In general, it has been found necessary to employ sophisticated computer programs to arrive at the proper transfer function to satisfactorily knit the various frequency range segments together. Such computer programs would, for example, take into consideration the electrical characteristics of the drivers employed. It has been found that, as a departure from conventional crossover designs, the filters of the crossover are made to overlap, are made to have non-integer order filter characteristics, and are made to have non-constant frequency response slopes.

Figure 8:
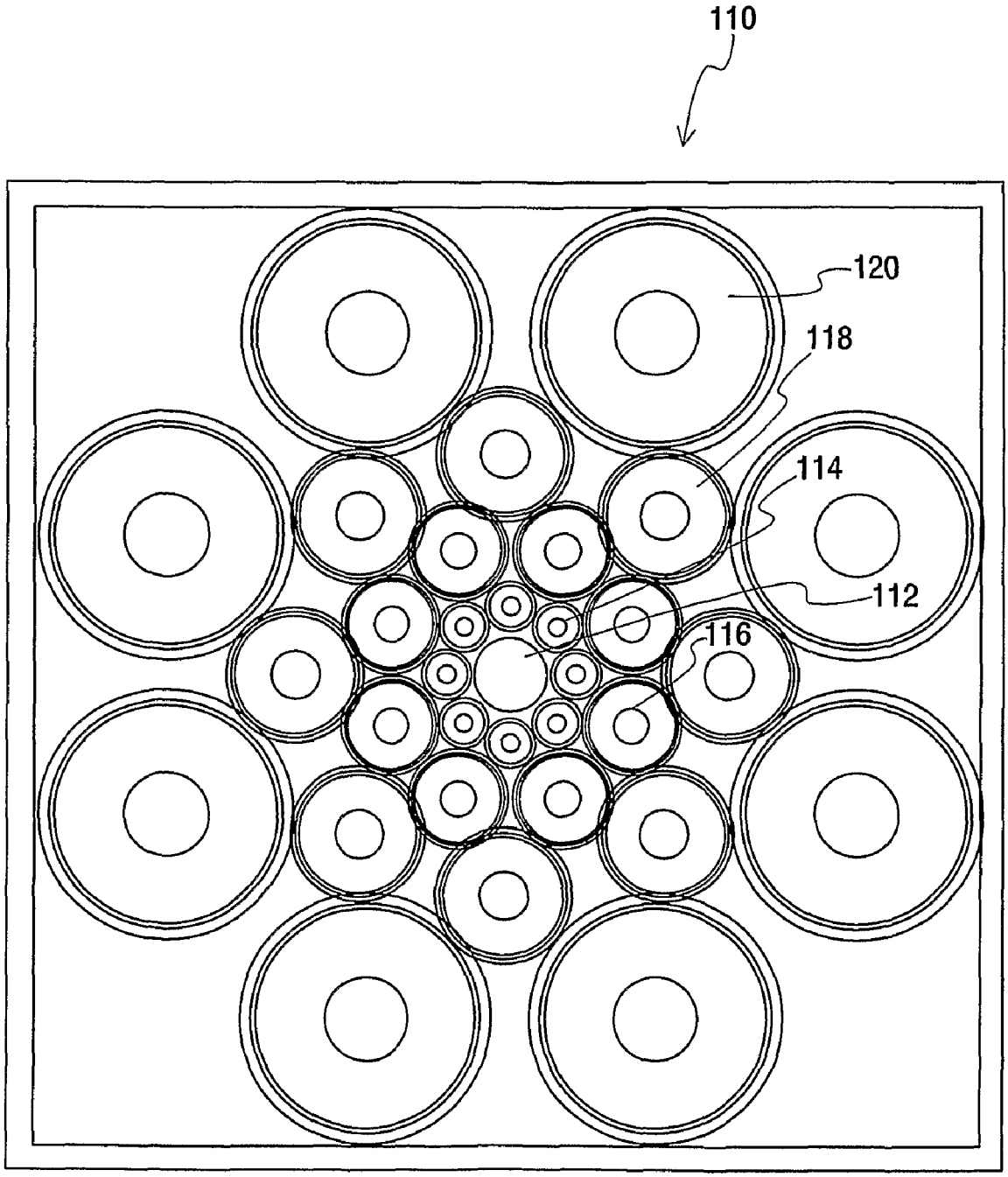
FIG. 8 is a schematic front elevational view of another sound reproduction system according to principles of the present invention.

Referring now to FIG. 8, a sound reproduction system according to principles of the present invention is generally indicated at 110. In the system 110, the horn angle of a simple round comical horn is increased to 180°, thus simulating a hole in the center of a flat baffle. Principles of the present invention can be applied to system 110, even though the system has significantly less driver loading than a typical horn, due to the rapid expansion of the area moving out from the hole 112 at the center of the system. Located adjacent the center of system 110 is a plurality of high frequency or "first range" drivers 114. While eight drivers are employed in the first range, other numbers of drivers could be employed as well. Surrounding of the first range drivers are several arrays of lower drivers, including eight second range drivers 116, eight third range drivers 118 and eight fourth range drivers 120. In the preferred embodiment illustrated in FIG. 8, the drivers of each range are located along concentric circles, with the rings or circular arrays of drivers being nested one within the other. Preferably, the highest frequency range is located at the center and progressively lower frequency ranges are encountered until the outer ring is reached.

It may be desirable in certain instances, to reduce the radiation angle, defined by the wall angle of system 110, below 180°. This may be accomplished by increasing the diameter of each radiator bring to be about one third wavelength or more at its high cut off. This also achieves the second aspect of horn design according to principles of the present invention, which draws attention to the local cross-sectional area of the horn where lower drivers are located. According to this aspect, at the upper frequency end of each of the lower drivers, the cross-sectional area of the horn, where the driver output enters the horn, must be no greater than the area approximated by a round cross section that is one wavelength in circumference at that frequency.

The foregoing description and the accompanying drawings are illustrative of the present invention. Still other variations in arrangements of parts are possible without departing from the spirit and scope of this invention.

I claim:

1. A system for reproducing sound, comprising:

a sound barrier defining a horn passageway having a first end and a second open end;

at least one high frequency range driver at the first end;

at least one lower driver operating in a frequency range lower than the high frequency range driver;

the at least one high frequency range driver and the at least one lower driver mutually coupled to the horn passageway;

the at least one lower driver having an upper frequency end lower than a frequency of a first cancellation notch for the at least one lower driver.

2. The system of claim 1 further comprising a second lower driver operating in approximately the same frequency range as the at least one lower driver.

3. The system of claim 1 comprising two pairs of lower drivers operating in different frequency ranges.

4. The system of claim 1 wherein the at least one lower driver is mounted to the sound barrier outside of the horn passageway and sound communication to the horn passageway is provided by an aperture in the sound barrier.

5. A system for reproducing sound, comprising:

a sound barrier defining a horn passageway having a first end and a second open end;

at least one high frequency range driver at the first end;

at least one lower driver operating in a frequency range lower than the high frequency range driver;

the at least one high frequency range driver and the at least one lower driver mutually coupled to the horn passageway;

the lower driver having an upper frequency end and being located at a preselected position along the horn passageway at which the passageway has a preselected cross-sectional area which is no greater than an area of a round cross section having a circumference equal to one wavelength of the upper frequency.

6. A system for reproducing sound, comprising:

a sound barrier defining a horn passageway having a first end and a second open end;

at least one high frequency range driver at the first end;

at least one lower driver operating in a frequency range lower than the high frequency range driver;

the at least one high frequency range driver and the at least one lower driver mutually coupled to the horn passageway;

the lower driver having a lower frequency end and being located at a point along the horn passageway having a preselected expansion rate which is slower or equal to the low cut off or expansion rate governed by the high pass frequency for the horn.

* * * * *